US012287120B2

(12) United States Patent
Benedetti et al.

(10) Patent No.: US 12,287,120 B2
(45) Date of Patent: Apr. 29, 2025

(54) ADIABATIC COOLING SYSTEM

(71) Applicant: Modine Manufacturing Company, Racine, WI (US)

(72) Inventors: Roberto Benedetti, Pocenia (IT); Andrea Tullis, Pocenia (IT); Anedy Vuaran, Pocenia (IT)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 18/723,230

(22) PCT Filed: Jul. 5, 2023

(86) PCT No.: PCT/US2023/026950
§ 371 (c)(1),
(2) Date: Jun. 21, 2024

(87) PCT Pub. No.: WO2025/010066
PCT Pub. Date: Jan. 9, 2025

(65) Prior Publication Data
US 2025/0012461 A1 Jan. 9, 2025

(51) Int. Cl.

| | |
|---|---|
| ***F24F 5/00*** | (2006.01) |
| ***F24F 13/30*** | (2006.01) |
| ***F24F 110/10*** | (2018.01) |
| ***F24F 110/20*** | (2018.01) |

(52) U.S. Cl.
CPC ..... *F24F 5/0035* (2013.01); *F24F 13/30* (2013.01); *F24F 2110/10* (2018.01); *F24F 2110/20* (2018.01)

(58) Field of Classification Search
CPC .. F24F 5/0035; F24F 6/04; F24F 13/30; F24F 2110/20; F24F 2110/10; F24F 2110/22; F24F 2110/12
See application file for complete search history.

(56) References Cited

U.S. PATENT DOCUMENTS

| | | | |
|---|---|---|---|
| 2,725,729 | A | 12/1955 | Mills |
| 2,856,166 | A | 10/1958 | Goettl |
| 3,058,726 | A | 10/1962 | Goettl |

(Continued)

FOREIGN PATENT DOCUMENTS

| | | | |
|---|---|---|---|
| EP | 1028302 | A2 | 8/2000 |
| EP | 738861 | B1 | 10/2002 |

(Continued)

OTHER PUBLICATIONS

International Search Report and Written Opinion for Application No. PCT/US2023/026950 dated Mar. 21, 2024 (14 pages).

*Primary Examiner* — Tavia Sullens
(74) *Attorney, Agent, or Firm* — Michael Best & Friedrich LLP

(57) ABSTRACT

An adiabatic cooling system including a controller is operable to determine a time period between a first cycle in a recovery mode and a second cycle in the recovery mode. If the time period is less than a first preset time period, then there is a first time lapse before the controller enters the fluid supply mode, and if the time period is greater than a second preset time period, then there is a second time lapse before the controller enters the fluid supply mode, and the first time lapse is greater than the second time lapse.

14 Claims, 17 Drawing Sheets

(56) References Cited

U.S. PATENT DOCUMENTS

| | | | | |
|---|---|---|---|---|
| 3,116,612 | A | 1/1964 | Pennington | |
| 3,427,005 | A | 2/1969 | Kuykendall | |
| 3,606,982 | A | 9/1971 | Les | |
| 3,738,621 | A | 6/1973 | Anderson | |
| 4,026,971 | A | 5/1977 | Glasoe | |
| 4,182,131 | A | 1/1980 | Marshall et al. | |
| 4,312,819 | A | 1/1982 | Leyland | |
| 4,361,525 | A | 11/1982 | Leyland | |
| 4,379,712 | A | 4/1983 | Sperr, Jr. et al. | |
| 4,468,357 | A | 8/1984 | Miller et al. | |
| 4,510,766 | A * | 4/1985 | Curtis, Sr. | F28D 5/00 62/171 |
| 4,698,979 | A | 10/1987 | Mcguigan | |
| 4,752,419 | A | 6/1988 | Sperr, Jr. et al. | |
| 5,374,380 | A | 12/1994 | James | |
| 5,724,828 | A | 3/1998 | Korenic | |
| 5,857,350 | A | 1/1999 | Johnson et al. | |
| 5,966,953 | A | 10/1999 | Murr et al. | |
| 6,101,831 | A | 8/2000 | Ciccone | |
| 6,338,471 | B1 | 1/2002 | Imsdahl et al. | |
| 6,367,277 | B1 | 4/2002 | Kinkel | |
| 6,438,986 | B1 | 8/2002 | Beverly | |
| 6,575,436 | B2 | 6/2003 | Litz | |
| 6,598,414 | B1 | 7/2003 | Cline | |
| 6,895,772 | B2 | 5/2005 | Johnson et al. | |
| 7,014,174 | B2 | 3/2006 | Roberts et al. | |
| 7,131,639 | B2 | 11/2006 | Kammerzell et al. | |
| 7,310,962 | B2 | 12/2007 | Cooke | |
| 7,600,743 | B2 | 10/2009 | Dorin et al. | |
| 7,862,011 | B2 | 1/2011 | Kammerzell et al. | |
| 9,383,142 | B2 | 7/2016 | Habeebullah | |
| 10,132,577 | B2 | 11/2018 | Martell et al. | |
| 10,619,898 | B2 | 4/2020 | Hollander et al. | |
| 10,677,544 | B2 | 6/2020 | Rede et al. | |
| 10,788,268 | B2 | 9/2020 | Byrne | |
| 10,845,109 | B2 | 11/2020 | Echols | |
| 10,948,223 | B2 | 3/2021 | Tolouei Asbforoushani et al. | |
| 11,365,938 | B2 | 6/2022 | Strumenti et al. | |
| 11,549,756 | B2 | 1/2023 | Byrne | |
| 2002/0180074 | A1 | 12/2002 | Schmidt | |
| 2003/0136143 | A1 | 7/2003 | Johnson et al. | |
| 2004/0144110 | A1 | 7/2004 | Reeves et al. | |
| 2008/0173032 | A1 | 7/2008 | Kammerzell et al. | |
| 2010/0162737 | A1 | 7/2010 | Hall et al. | |
| 2010/0199693 | A1 | 8/2010 | Benesch | |
| 2011/0168354 | A1 | 7/2011 | De Jong et al. | |
| 2016/0178224 | A1 * | 6/2016 | Venturelli | F24F 5/0035 700/276 |
| 2017/0108251 | A1 * | 4/2017 | Dinnage | F24F 5/0035 |
| 2018/0224174 | A1 | 8/2018 | Hollander et al. | |
| 2018/0231264 | A1 | 8/2018 | Vadder et al. | |
| 2022/0120478 | A1 | 4/2022 | Kuppusamy | |
| 2022/0213976 | A1 | 7/2022 | Slayzak et al. | |
| 2022/0316826 | A1 | 10/2022 | Wright, Jr. et al. | |

FOREIGN PATENT DOCUMENTS

| | | | |
|---|---|---|---|
| EP | 1698847 | A1 | 9/2006 |
| EP | 1920207 | B1 | 8/2009 |
| EP | 3306227 | A1 | 4/2018 |
| EP | 3470747 | A1 | 4/2019 |
| EP | 3306247 | B1 | 5/2019 |
| EP | 3099981 | B1 | 3/2020 |
| EP | 3699504 | A1 | 8/2020 |
| EP | 3143358 | B1 | 10/2020 |
| EP | 3361200 | B1 | 5/2021 |
| EP | 3988880 | A1 | 4/2022 |
| WO | 1999036734 | A1 | 7/1999 |
| WO | 2003085328 | A1 | 10/2003 |
| WO | 2004068051 | A2 | 8/2004 |
| WO | 2005120679 | A2 | 12/2005 |
| WO | 2007015281 | A3 | 3/2008 |
| WO | 2008151377 | A1 | 12/2008 |
| WO | 2010037164 | A1 | 4/2010 |
| WO | 2011074005 | A2 | 6/2011 |
| WO | 2015108603 | A1 | 7/2015 |
| WO | 2015145465 | A2 | 10/2015 |
| WO | 2015173767 | A1 | 11/2015 |
| WO | 2015199676 | A1 | 12/2015 |
| WO | 2017066636 | A1 | 4/2017 |
| WO | 2017082714 | A1 | 5/2017 |
| WO | 2017160346 | A1 | 9/2017 |
| WO | 2018148460 | A1 | 8/2018 |
| WO | 2019060463 | A2 | 3/2019 |
| WO | 2020236152 | A1 | 11/2020 |
| WO | 2022110670 | A1 | 6/2022 |
| WO | 2022212856 | A1 | 10/2022 |

* cited by examiner

ADIABATIC COOLING SYSTEM

BACKGROUND

The present invention relates to adiabatic cooling systems.

SUMMARY

In one embodiment, the invention provides an adiabatic cooling system including a housing, a heat exchanger coupled to the housing, and the heat exchanger configured to cool a working fluid. The system further includes an evaporative panel coupled to the housing and a fan coupled to the housing and operable to draw an airflow through the evaporative panel and the heat exchanger to cool the working fluid within the heat exchanger. A fluid supply circuit is configured to receive a fluid from a fluid supply, the fluid supply circuit includes a supply valve operable to control fluid flow from the fluid supply through the fluid supply circuit to deliver the fluid to the evaporative panel to wet the evaporative panel using fluid from the fluid supply. A collector is coupled to the housing and configured to receive a recovery fluid from the evaporative panel. A fluid level sensor configured to detect a recovery fluid level in the collector. A recovery fluid circuit is in fluid communication with the collector, the recovery fluid circuit including a recovery valve operable to control fluid flow through the recovery fluid circuit to deliver the recovery fluid to the evaporative panel to wet the evaporative panel using recovery fluid from the collector. A controller is in communication with the fluid level sensor and the controller operable to control operation of the fan, the supply valve, and the recovery valve. When the recovery fluid level in the collector is less than a first predetermined amount, the controller operates in a fluid supply mode where the supply valve is open and the fluid supply circuit directs the fluid from the fluid supply to the evaporative panel to wet the evaporative panel using the fluid from the fluid supply. When the recovery fluid level in the collector is greater than a second predetermined amount, the controller operates in a recovery mode where the recovery valve is open and the recovery fluid circuit directs the recovery fluid from the collector to the evaporative panel to wet the evaporative panel using the recovery fluid from the collector. The controller is operable to determine a time period between a first cycle in the recovery mode and a second cycle in the recovery mode, if the time period is less than a first preset time period, then there is a first time lapse before the controller enters the fluid supply mode, and if the time period is greater than a second preset time period, then there is a second time lapse before the controller enters the fluid supply mode, and wherein the first time lapse is greater than the second time lapse.

In another embodiment, the invention provides a method of controlling an adiabatic cooling system including an evaporative panel and a heat exchanger, the method includes wetting an evaporative panel with a fluid, collecting, in a collector, a recovery fluid from the evaporative panel, and determining a fluid level in the collector. The method further includes operating in a fluid supply mode when the fluid level in the collector is less than a first predetermined amount, the fluid supply mode includes wetting the evaporative panel using fluid from a fluid supply. The method further includes operating in a recovery mode when the fluid level in the collector is greater than a second predetermined amount, the recovery mode includes wetting the evaporative panel using fluid from the collector. The method further includes determining a time period between a first cycle in the recovery mode and a second cycle in the recovery mode, if the time period is less than a first preset time period, then there is a first time lapse before entering the fluid supply mode from the recovery mode, and if the time period is greater than a second preset time period, then there is a second time lapse before entering the fluid supply mode from the recovery mode, and the first time lapse is greater than the second time lapse.

Before any constructions of the invention are explained in detail, it is to be understood that the invention is not limited in its application to the details of construction and the arrangement of components set forth in the following description or illustrated in the following drawings. The invention is capable of other constructions and of being practiced or of being carried out in various ways.

DETAILED DESCRIPTION

Figure 1:
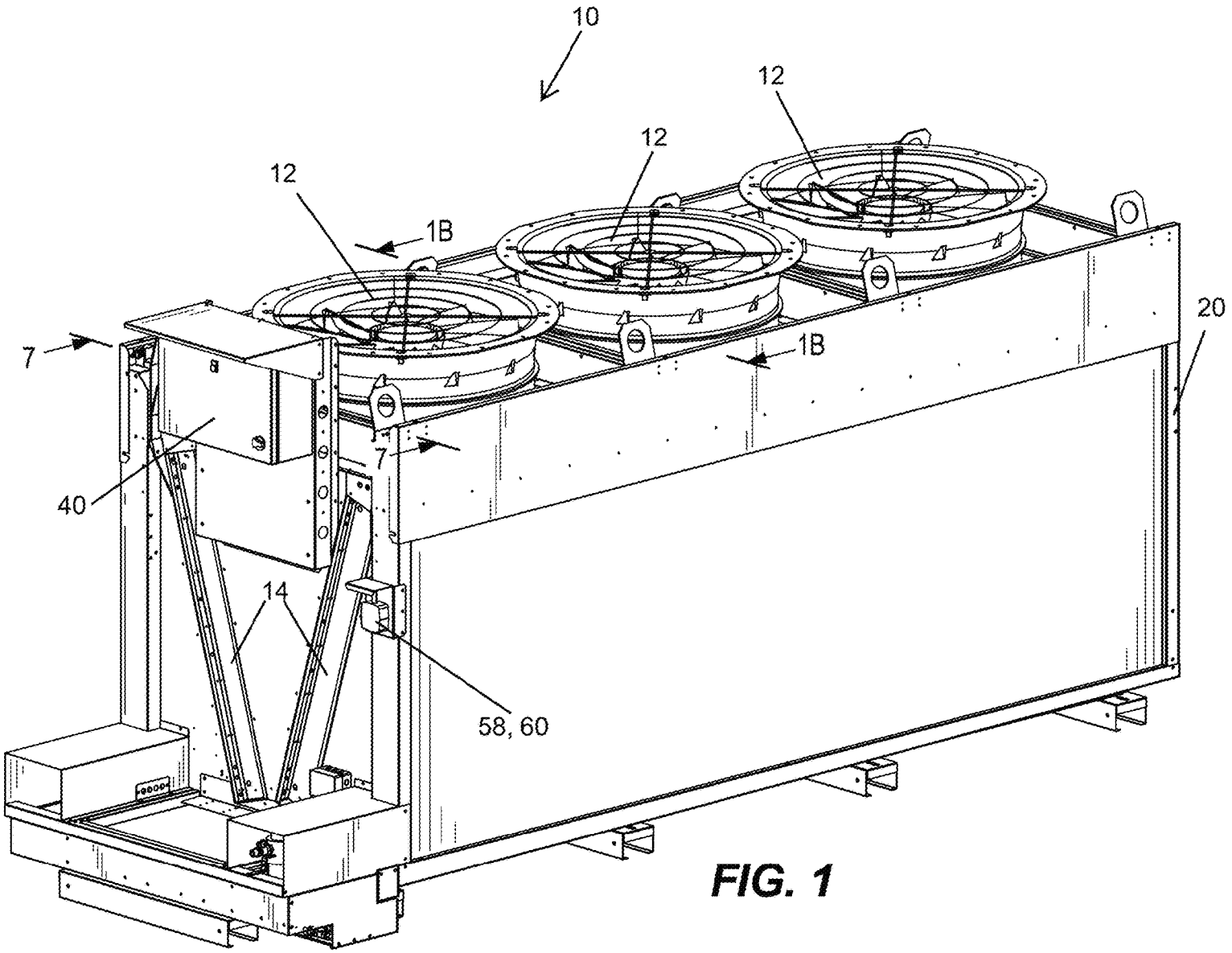
FIG. 1 is a perspective view of an adiabatic cooling system according to an embodiment.
Figure 1B:
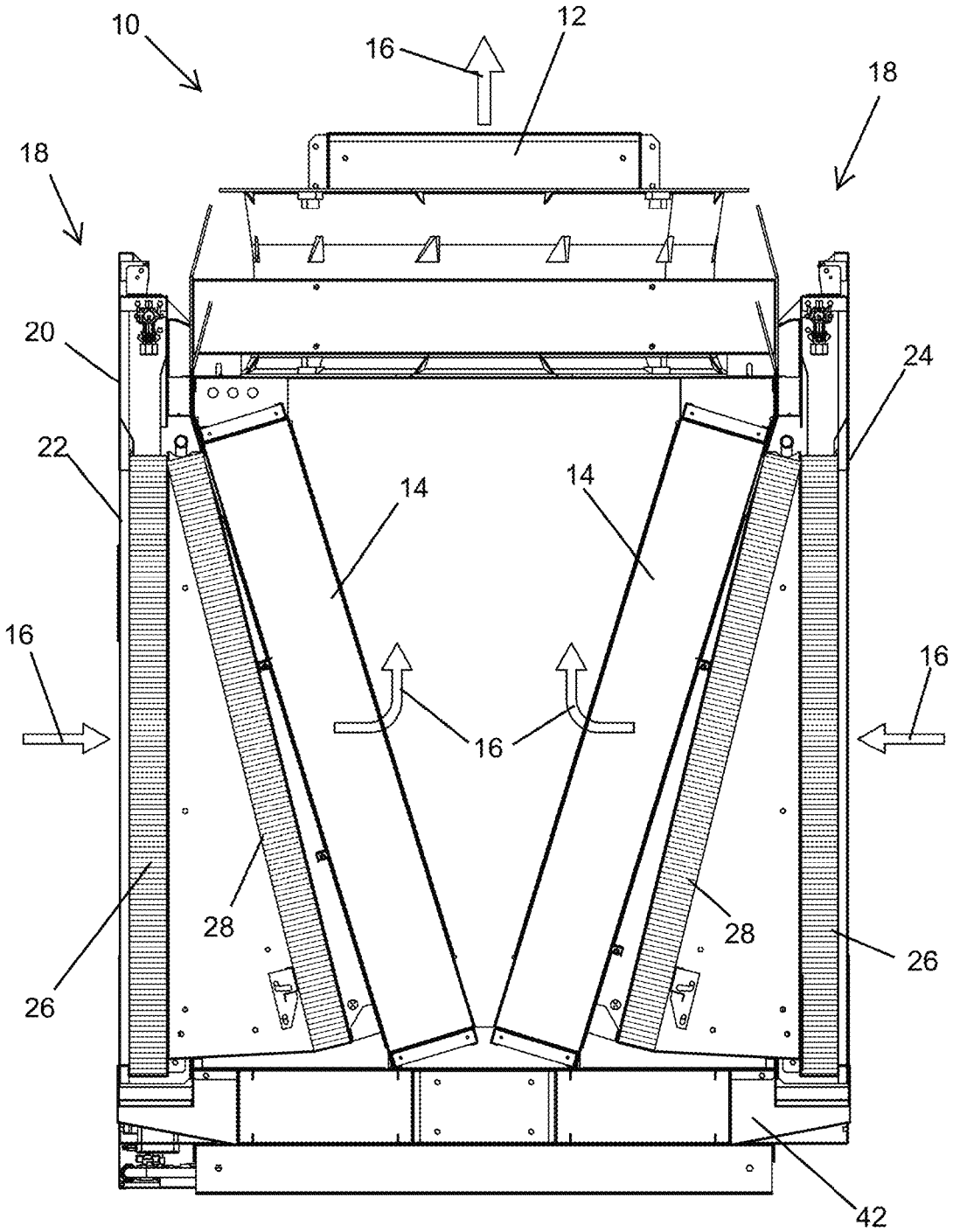
FIG. 1B is cross-sectional view of the adiabatic cooling system of FIG. 1 taken along the line 1B-1B of FIG. 1.

FIGS. 1 and 1B illustrate an adiabatic cooling system 10 including fans 12 and heat exchangers 14. The fans 12 draw an airflow 16 through the heat exchangers 14 to cool a working fluid in the heat exchangers 14. As discussed in more detail below, the system 10 also includes an adiabatic system including evaporative panels 18 that are wetted during an adiabatic mode of operation to cool the airflow before the airflow passes through the heat exchangers 14. As further discuss below, the system 10 includes feature that minimize the water used to wet the panels 18.

Referring to FIG. 1B, the adiabatic cooling system 10 includes a housing 20 having a first side 22 and a second side 24 opposite the first side 22. In the illustrated system 10, the evaporative panels 18 are coupled to the housing 20 and include a first or outer evaporative panel 26 adjacent the first and second sides 22, 24 and a second or inner evaporative panel 28 between the outer panel 26 and the heat exchangers 14. The illustrated evaporative panels 26, 28 are arranged in a generally inverted V-shape. The evaporative panels 26, 28 are located upstream of the heat exchangers 14 such that the fans 12 draw the airflow 16 through the evaporative panels 26, 28 before drawing the airflow through the heat exchangers 14.

The heat exchangers 14 are coupled to the housing 20 in a V-shaped orientation in the illustrated embodiment. A working fluid (e.g., freon, carbon dioxide ($CO_2$), brine, or any other suitable working fluid is circulated through the heat exchangers 14. The system 10 is operable to cool the working fluid and the system 10 supplies the cooled working fluid to any suitable component that requires cooling and the cooled working fluid. The fans 12 draw the airflow 16 across the heat exchangers 14 such that heat from the working fluid is transferred to the airflow 16 thereby cooling the working fluid, which results in heating the airflow 16 that is exhausted from the system. In the illustrated embodiment, the fans 12 are located above and between the heat exchangers 14 such that the airflow 16 is drawn through the heat exchangers 14, between the heat exchangers 14 and then up and through the fans 12 and exhausted from the system 10.

As discussed in greater detail below, under certain ambient air conditions the outer and inner evaporative panels 26, 28 are dry or not wetted by the system 10 such that the panels 26, 28 have little to no impact on the temperature of the airflow 16 drawn across the panels 26, 28. Under other ambient air conditions the outer and inner evaporative panels 26, 28 are wetted, which cools the airflow 16 before the airflow 16 is drawn through the heat exchangers 14 to cool the working fluid.

Referring to FIGS. 4-7, the adiabatic cooling system 10 includes a fluid supply circuit 30. The fluid supply circuit 30 uses a supply fluid (e.g., water) from a fluid supply 32 (e.g., a water main) to wet the outer evaporative panels 26. The fluid supply circuit 30 includes piping 34, a supply valve 36, and supply spray nozzles 38. The supply spray nozzles 38 are positioned above the outer evaporative panels 26 and position to spray the supply fluid/water onto the outer evaporative panels 26. The system 10 includes a controller 40 (FIG. 1). The controller 40 moves the supply valve 36 between open and closed positions. In the open position, the supply fluid can move from the fluid supply 32 to the supply nozzles 38 to wet the outer panels 26. In the closed position, the supply fluid is prevented from moving to the supply nozzles 38.

Referring to FIGS. 9-12, the system 10 includes a collector 42. The collector 42 includes a reservoir or sump that collects excess fluid (i.e., recovery fluid) that runs off the evaporative panels 26, 28. The collector 42 is below the outer and inner evaporative panels 26, 28 such that gravity collects the excess fluid from the panels 26, 28 in the collector 42. A fluid level sensor 44 (FIG. 6), which is in communication with the controller 40, detects a recovery fluid level in the collector 42 and communicates the recovery fluid level to the controller 40. In the illustrated embodiment, the fluid level sensor 44 is positioned in the collector 42 but may be positioned elsewhere in other embodiments. In some embodiments, the collector 42 includes a drain 46 (FIG. 15) that is openable to allow the recovery fluid to drain from the collector 42.

With continued reference to FIGS. 9-12, the system 10 includes a fluid recovery circuit 48. The fluid recovery circuit 48 circulates the recovery fluid from the collector 42 to wet the inner evaporative panels 28. The fluid recovery circuit 48 includes piping 50, a recovery valve 52, a pump 54, and spray apertures 56. The spray apertures 56 are positioned above the inner evaporative panels 28. The controller 40 is in communication with and controls the recovery valve 52 to move the recovery valve 52 between open and closed positions. The controller 40 is also in communication with and controls operation of the pump 54. When the recovery valve 52 is open and the pump is on, the recovery fluid in the collector 42 is pumped from the collector 42 to the spray apertures 56 to wet the inner evaporative panels 28. In the closed position of the recovery valve 52, the pump 54 is off and recovery fluid is prevented from being pumped and supplied to the inner panels 28.

Referring to FIG. 1, the adiabatic cooling system 10 further includes a temperature sensor 58 and an air humidity sensor 60 that are both in communication with the controller 40. The sensors 58, 60 and the controller 40 monitor temperature and humidity of the ambient air surrounding the adiabatic cooling system 10. As discussed below, the controller 40 determines whether to operate the system 10 using the fans 12 in a dry mode where the panels 26, 28 are not wetted or whether to operate the system 10 in an adiabatic mode where the panels 26, 28 are wetted.

Figure 2:
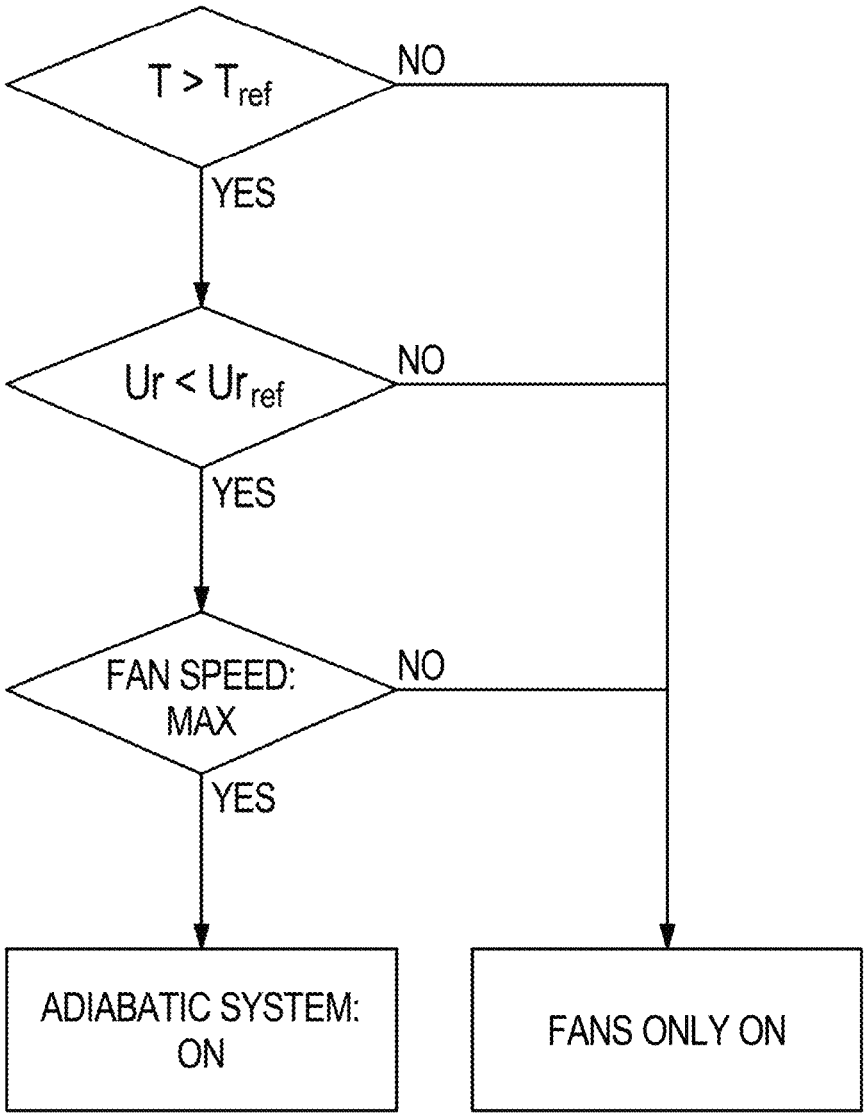
FIG. 2 is a flow diagram illustrating a mode of operating the adiabatic cooling system of FIG. 1.
Figure 3:
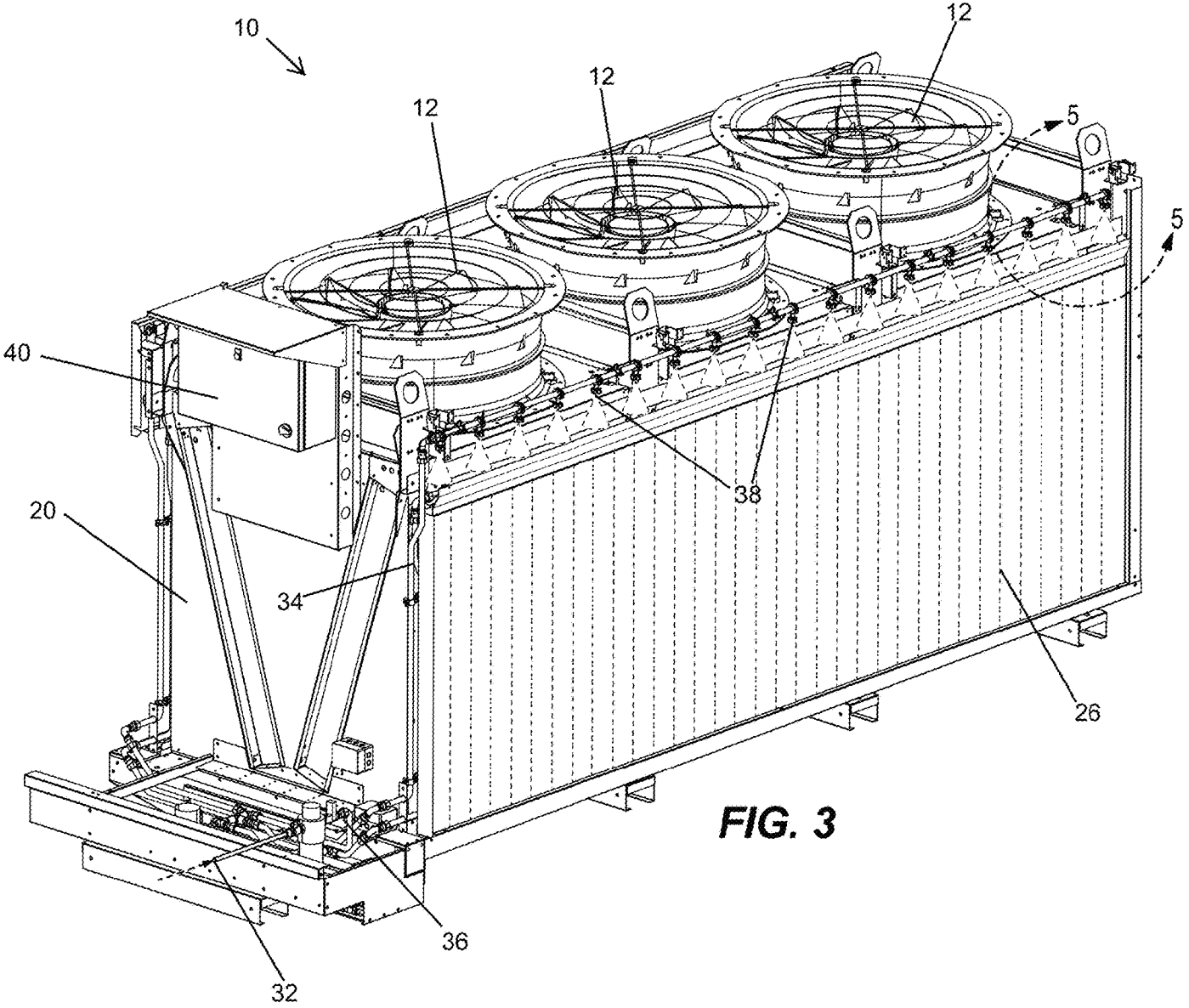
FIG. 3 illustrates a perspective view of the adiabatic cooling system of FIG. 1 with a portion removed.
Figure 4:
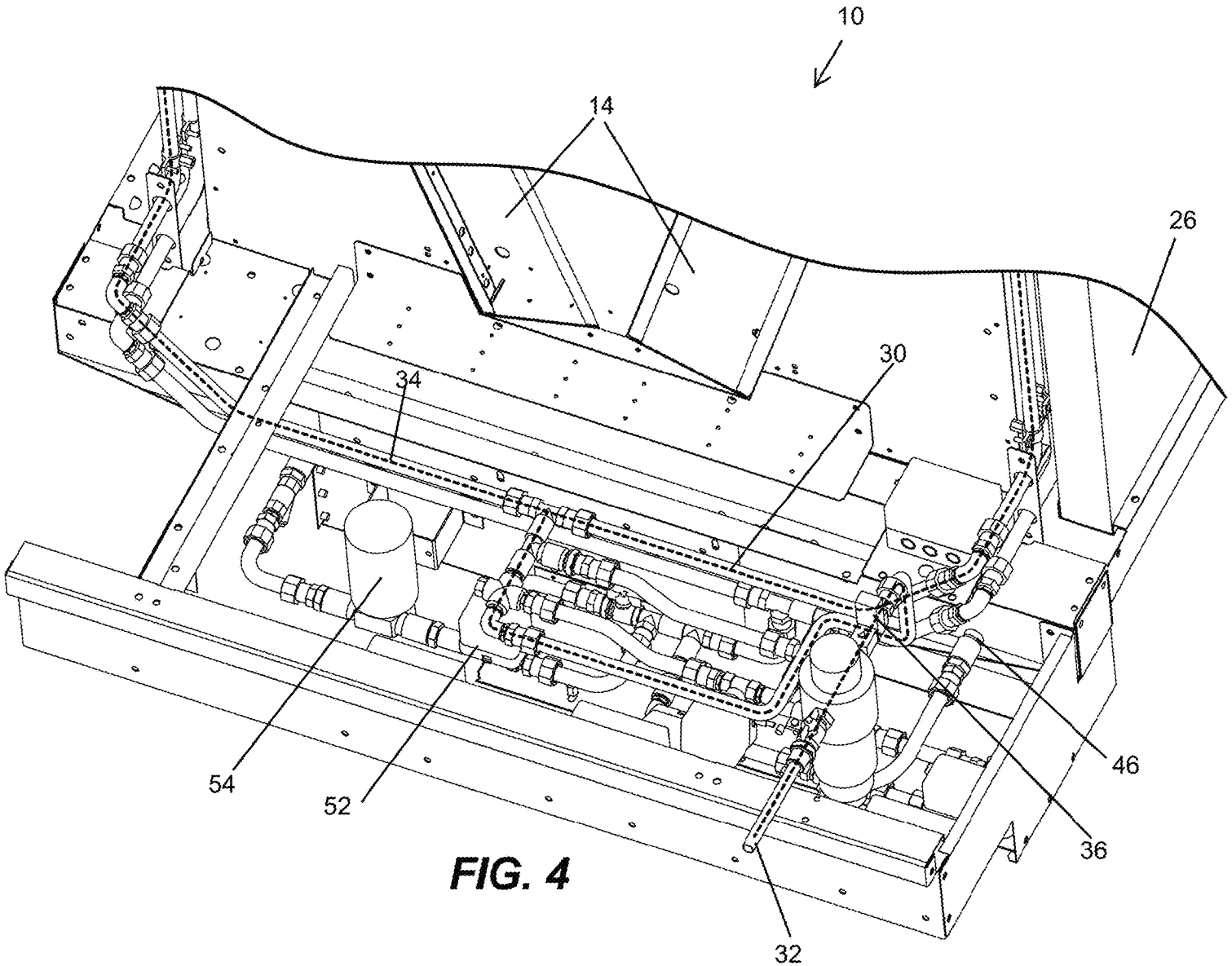
FIG. 4 illustrates a perspective view of the adiabatic cooling system of FIG. 1 with a portion removed and illustrating the system in operating in a fluid supply mode.
Figure 5:
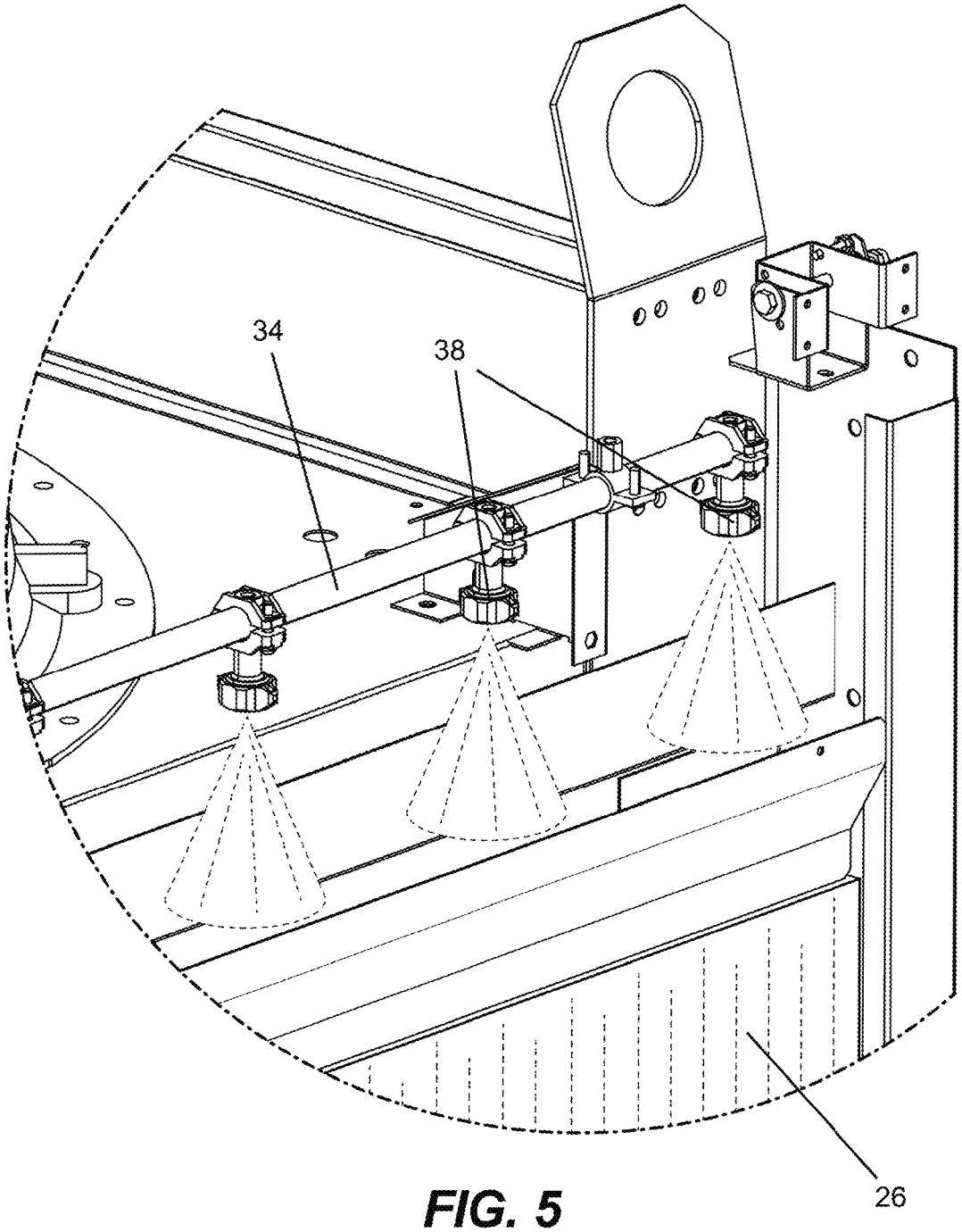
FIG. 5 is a detailed view of a portion of FIG. 3 illustrating the system operating in a fluid supply mode.
Figure 6:
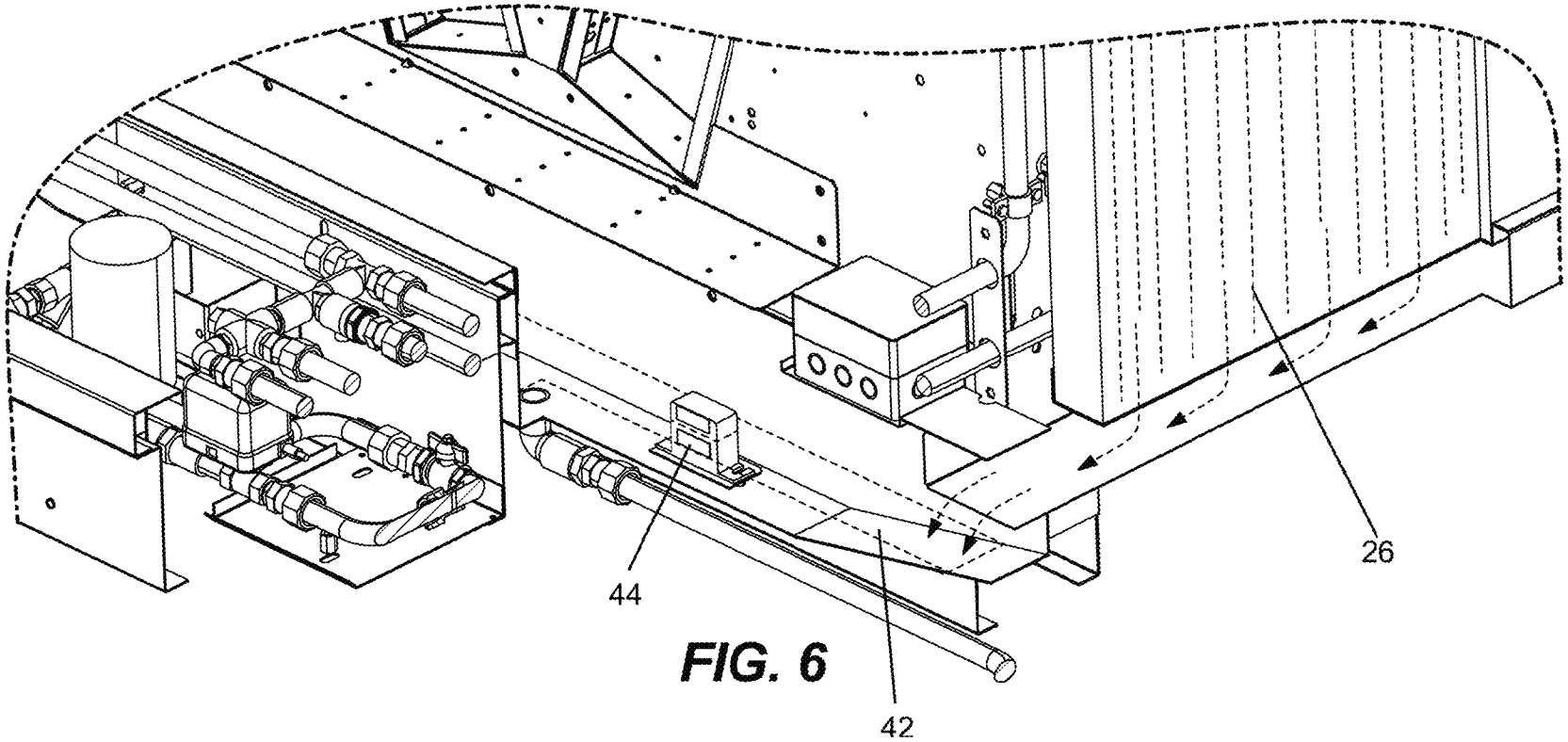
FIG. 6 is a detailed view of the adiabatic cooling system of FIG. 1 illustrating the system operating in the fluid supply mode.
Figure 7:
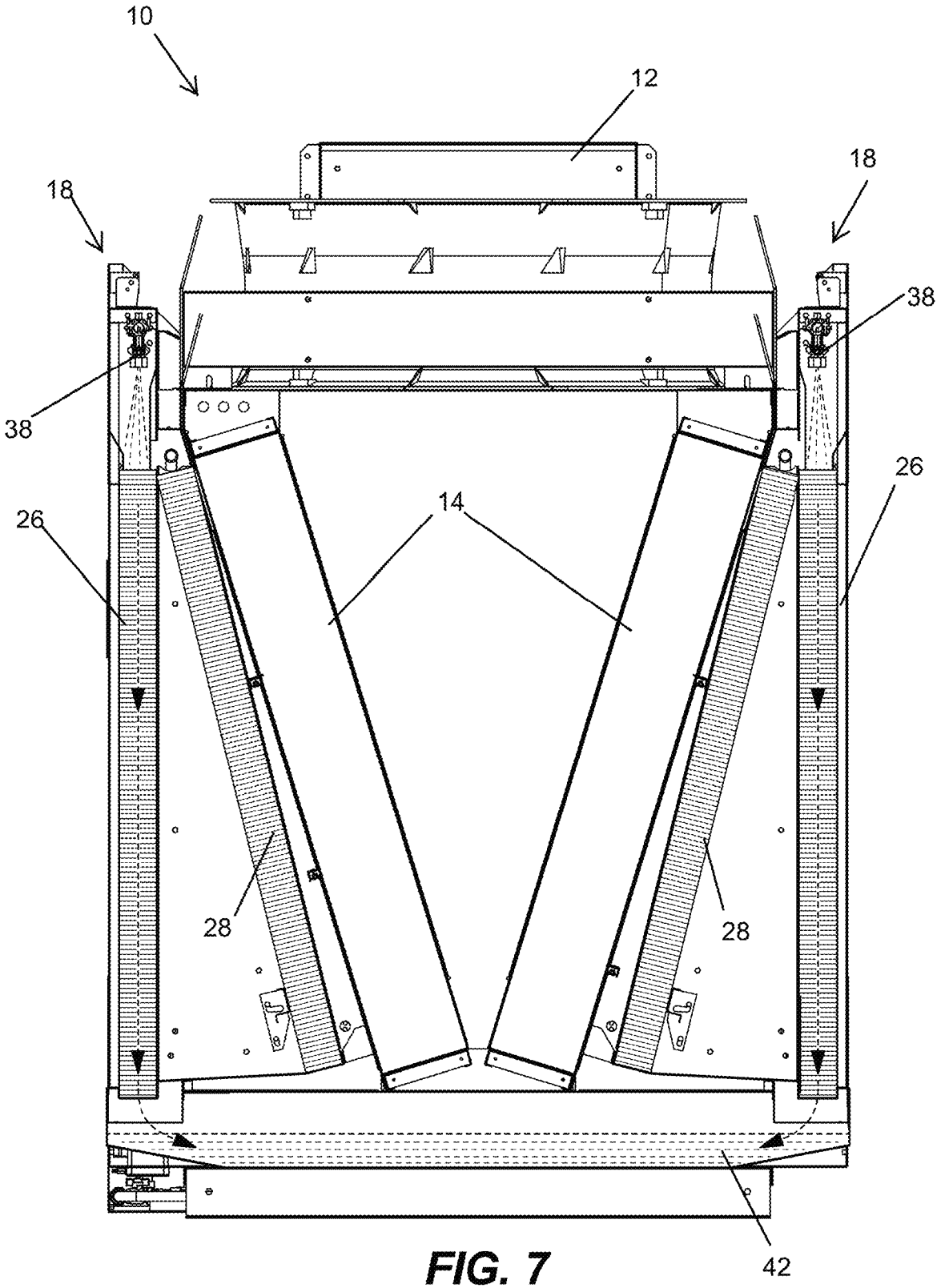
FIG. 7 is cross-sectional view of the adiabatic cooling system of FIG. 1 taken along the line 7-7 of FIG. 1 illustrating the system operating in the fluid supply mode.
Figure 8:
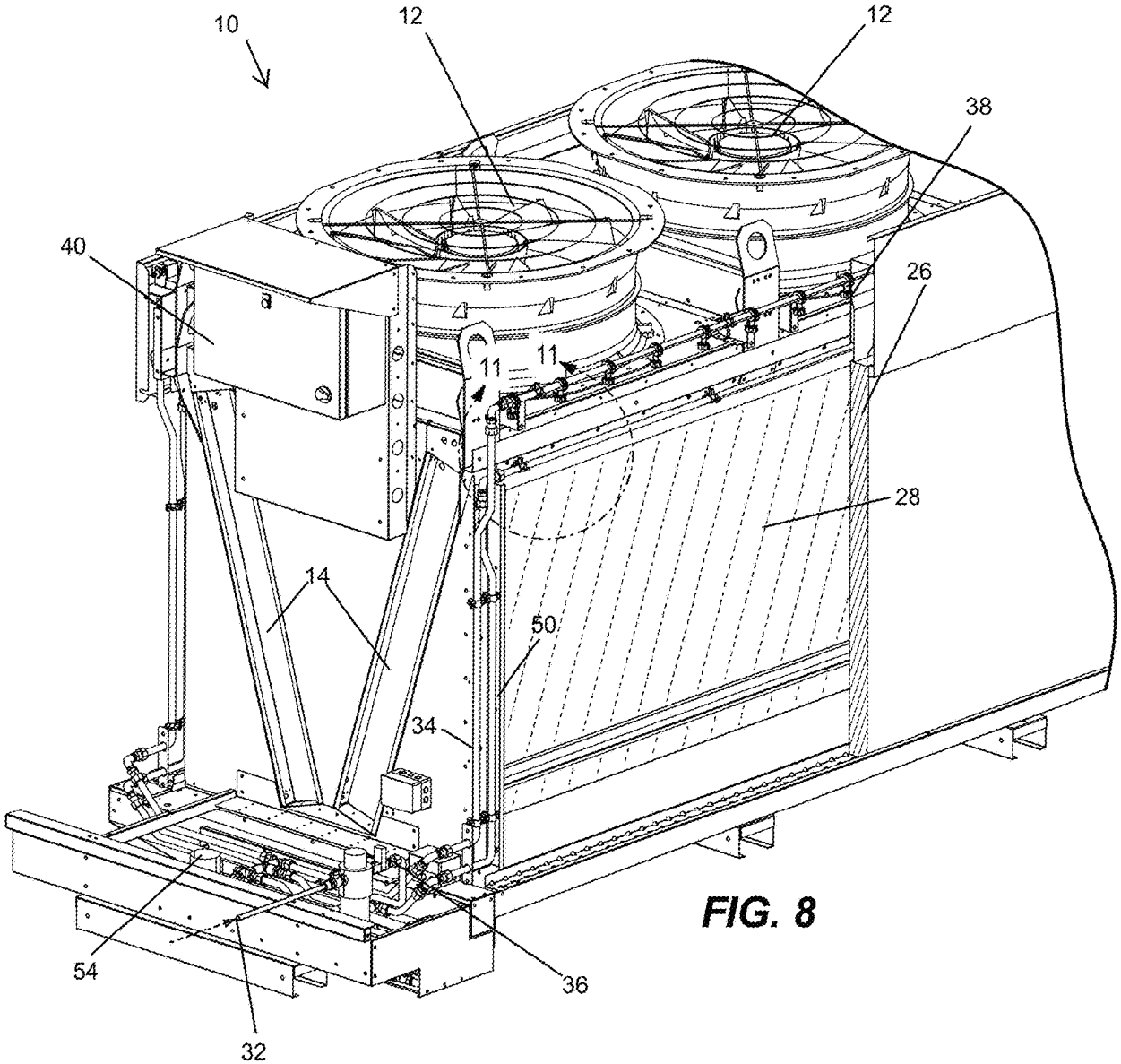
FIG. 8 is an alternative perspective view of the adiabatic cooling system of FIG. 1 with a portion removed.
Figure 9:
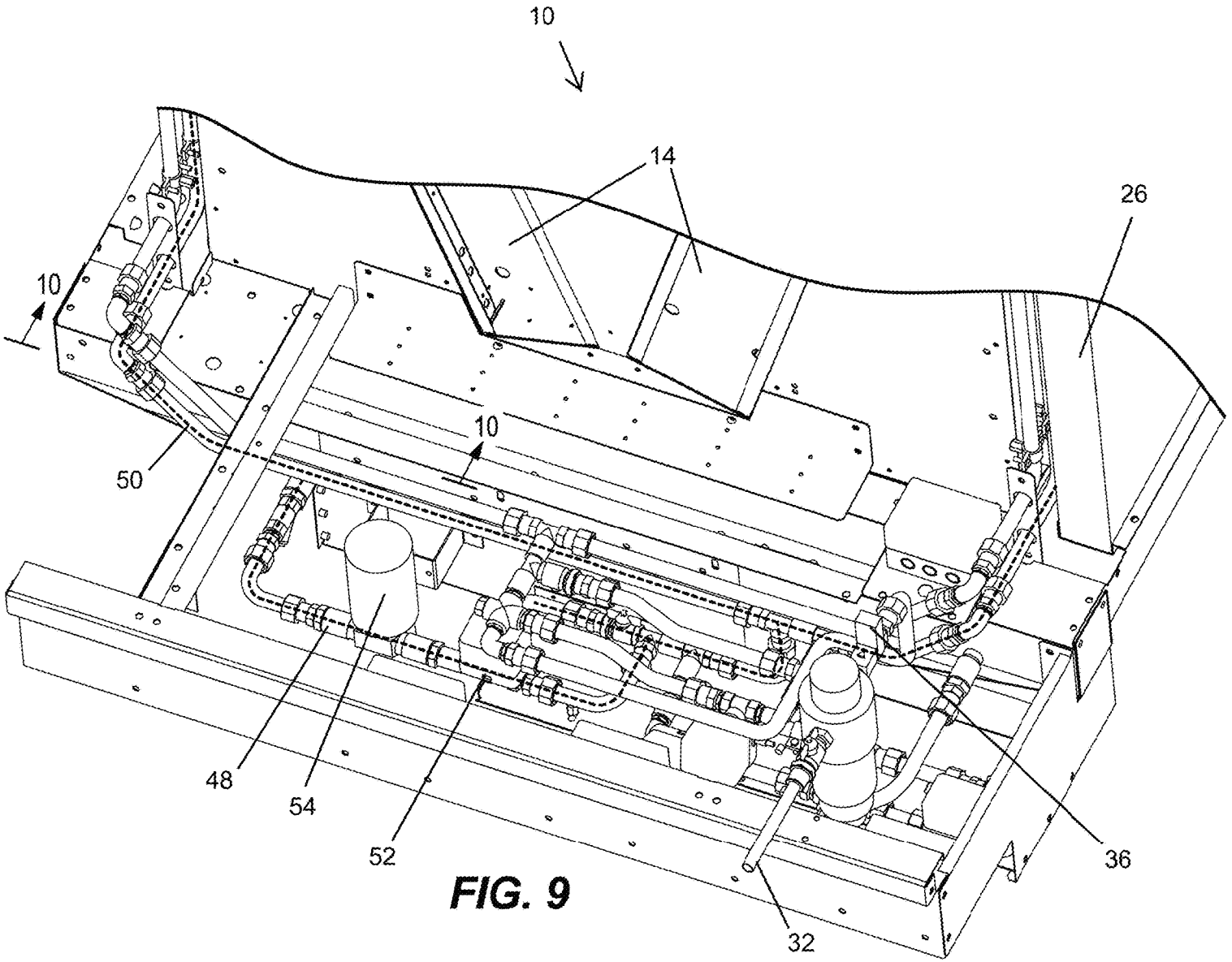
FIG. 9 illustrates a perspective view of the adiabatic cooling system of FIG. 1 with a portion removed and illustrating the system in operating in a recovery mode.
Figure 10:
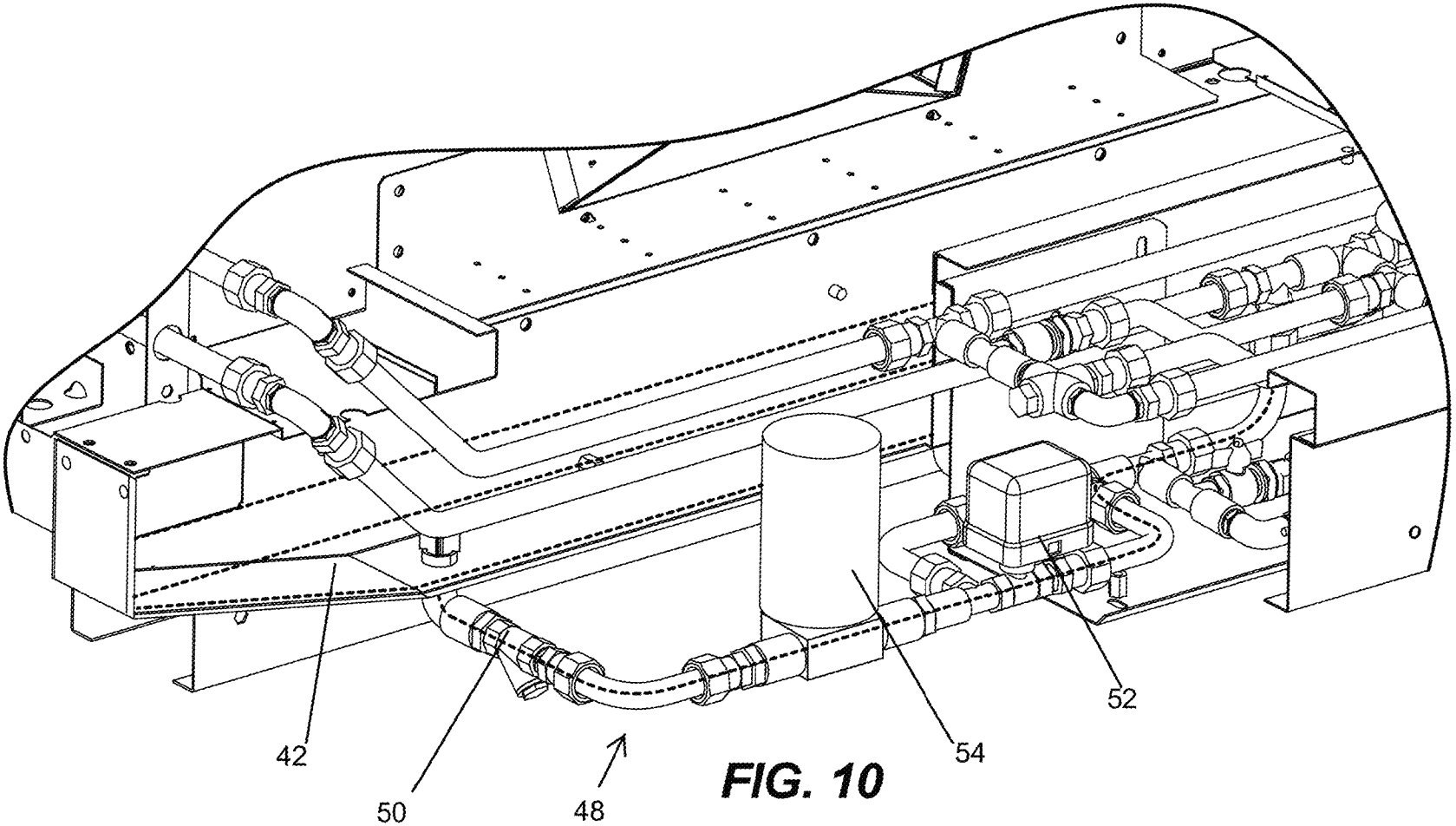
FIG. 10 is a detailed view of a portion of FIG. 9.
Figure 11:
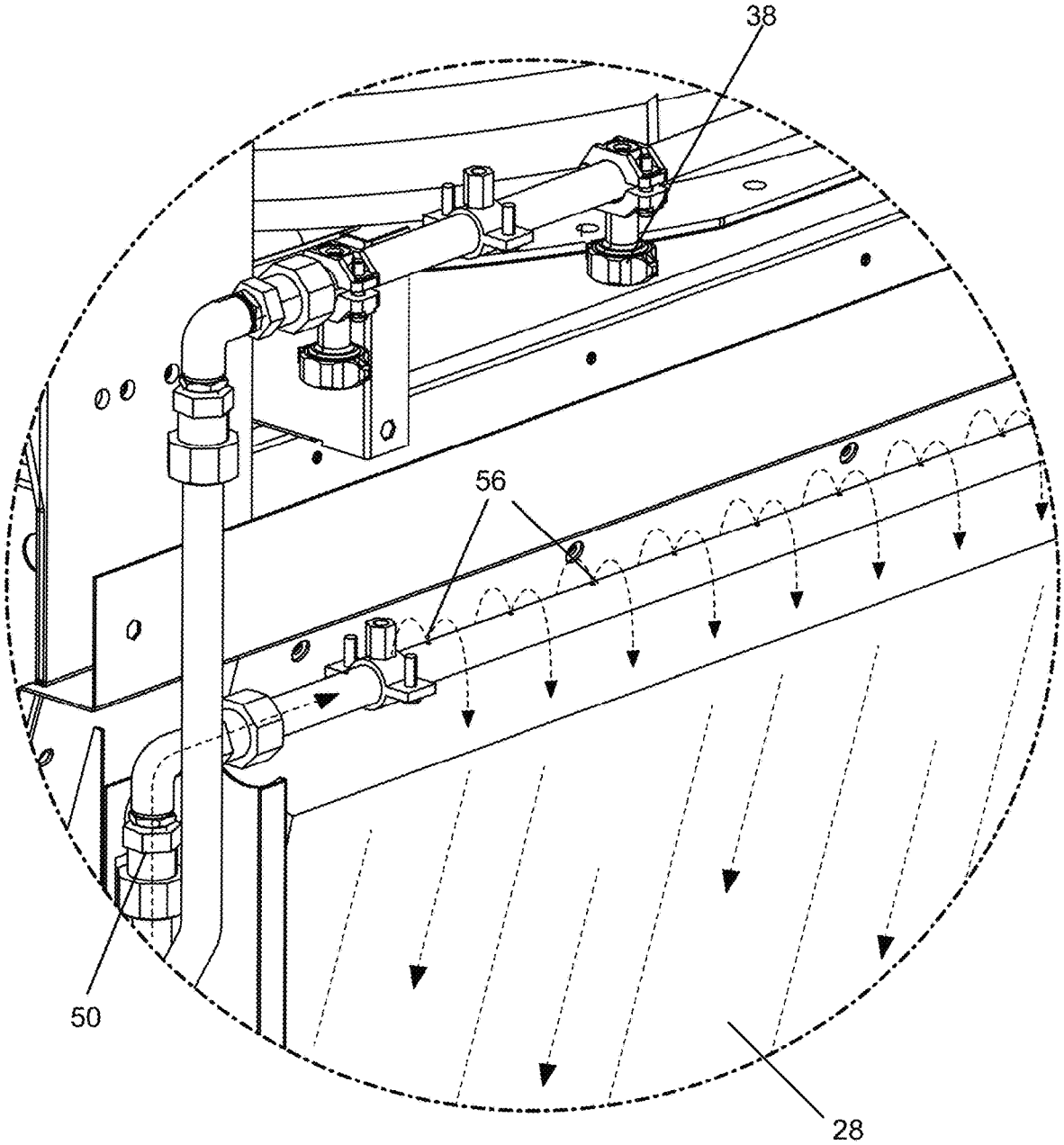
FIG. 11 illustrates a perspective view of the adiabatic cooling system of FIG. 1 with a portion removed and illustrating the system in operating in the recovery mode.
Figure 12:
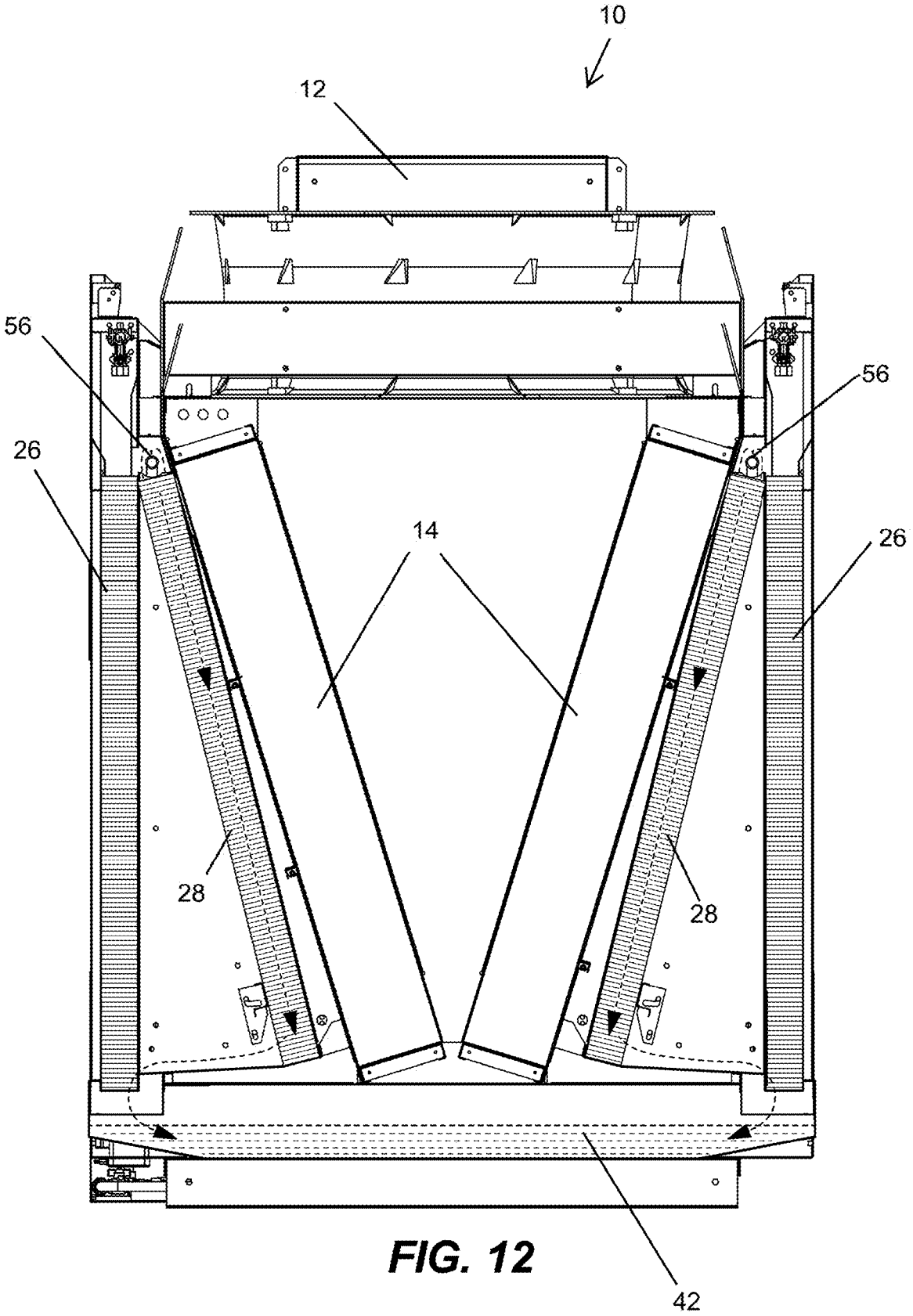
FIG. 12 is cross-sectional view of the adiabatic cooling system of FIG. 1 taken along the line 7-7 of FIG. 1 illustrating the system operating in the recovery mode.

Referring to FIG. 2, the controller 40 is programmed to operate the system 10 in a dry mode where the supply valve 36 is closed and the panels 26, 28 are not wetted when certain conditions are met. Thus, in the dry mode, the recovery mode and fluid recovery circuit 48 are disabled because excess fluid is not being recovered. In the dry mode, the fans 12 are used to draw the airflow 16 through the heat exchanger 14 to cool the working fluid without the aid of the panels 26, 28 being wetted. When the ambient temperature (T) external to the system 10 is less than a reference temperature ($T_{ref}$), the controller 40 operates the system 10 in the dry mode. When the external air relative humidity (Ur) is greater than a reference humidity (Ur ref), the controller 40 also operates the system 10 in the dry mode. The reference temperature ($T_{ref}$) and reference humidity (Ur ref) are determined based on the working conditions of the system 10, which may depend on the size of the system, cooling application, geographic location, etc.

In the dry mode, the evaporative panels 26, 28 are not wetted by the circuits 30, 48 of the adiabatic cooling system 10. That is, the adiabatic mode is disabled such that the fluid supply valve 36 is closed such that fluid from the fluid supply 32 is prevented from entering the fluid supply circuit 30 and just the fans are used to cool the working fluid in the heat exchangers 14 Airflow 16 enters the housing 20 and moves through the dry evaporative panels 26, 28 and flows through the heat exchangers 14. As a result, a temperature of the working fluid decreases while a temperature of the airflow increases. The airflow 16 flows out of the housing 20 through the fans 12

In the illustrated embodiment, the controller 40 is operable to control and operate the fans 12 at variable speeds in a range from a minimum fan speed (lowest airflow) to a maximum fan speed (highest airflow). The fan speed is controlled between the minimum and maximum speeds according to a setpoint (e.g., temperature or pressure of working fluid in the heat exchangers 14) that is different depending on features of the system 10 (e.g., size, application, geographic location, etc.). In one embodiment, the system 10 monitors the pressure of the working fluid at the outlet of the heat exchangers 14. If the pressure is higher than a setpoint, fan speed is increased. If the pressure is lower than a setpoint, fan speed is decreased. The gradient by which the fan speed is increased or decreased depends on the difference between the sensed pressure and the setpoint pressure. In another embodiment, the system 10 monitors the temperature of the working fluid at the outlet of the heat exchangers 10. If the temperature is greater than a setpoint, fan speed is increased. If the temperature is lower than the setpoint, fan speed is decreased. The gradient by which the fan speed is increased or decreased depends on the temperature difference between the sensed temperature and the setpoint temperature.

As shown in the flow chart in FIG. 2, when the speed of the fans 12 reaches the maximum value of fan speed and the ambient temperature (T) external to the system 10 is greater than the reference temperature ($T_{ref}$) and the external air relative humidity (Ur) is less than the reference humidity ($Ur_{ref}$), the controller 40 operates the system 10 in the adiabatic mode. In the adiabatic mode, the fluid supply circuit 30 is used to wet the outer evaporative panels 26 to cool the airflow 16 via evaporation before the airflow 16 passes through the heat exchangers 14. The panels 26 are wet so the relative humidity of the airflow 16 increases and the temperature of the airflow 16 decreases, reaching values that are close the wet bulb temperature. Also, in the adiabatic mode, the recovery fluid circuit 48 is utilized to recycle fluid collected in the collector 42 to wet the inner evaporative panels 28 to cool the airflow 16 via evaporation, like the outer evaporative panels 26, before the airflow 16 passes through the heat exchangers 14.

In the adiabatic mode, the system 10 is designed to minimize water consumption through the control and operation of the recovery fluid circuit 48 and the fluid supply circuit 30. More specifically, control of the system 10 is optimized using an adjustable time lapse to reduce continuous switching between the wetting of the outer evaporative panels 26 using the fluid supply circuit 30 and wetting of the inner evaporative panels 28 using the recovery fluid circuit 48, which minimizes the use or consumption of water from the fluid supply 32.

In the adiabatic mode, the controller 40 monitors the fluid level in the collector 42 using the fluid level sensor 44. When the recovery fluid level in the collector 42 is less than a predetermined amount, the controller 40 operates in a fluid supply mode (FIGS. 4-7) where the supply valve 36 is open and the fluid supply circuit 30 directs the fluid from the fluid supply 32 to the outer evaporative panels 26 to wet the outer evaporative panels 26 using the fluid or water from the fluid supply 32. In the fluid supply mode, the recovery fluid circuit 48 is disabled such that fluid is not recirculated from the collector 42 to the inner evaporative panels 28. Rather, excess water that runs off the outer evaporative panels is collected in the collector 42

When the controller 40 determines that the recovery fluid level in the collector 42 is greater than a predetermined amount, the controller 40 operates in a recovery mode (FIGS. 9-12) where the recovery valve 52 is open, the pump 54 is on, and the recovery fluid circuit 48 directs the recovery fluid from the collector 42 to the inner evaporative panels 28 to wet the inner evaporative panels 28 using the recovery fluid from the collector 42. In the recovery mode, the supply valve 36 closed such that additional fluid is not being consumed or introduced into the system 10 to wet the outer evaporative panels 26. While operating in the recovery mode, the controller 40, determines when the recovery fluid level in the collector 42 is below the predetermined amount and when the recovery fluid level in the collector 42 is below the predetermined amount, the controller 40 switches the adiabatic cooling system 10 back to the fluid supply mode described above.

The controller 40 determine a time period between a first cycle in the recovery mode and a second cycle in the recovery mode. That is, the controller 40 determine the amount of time that has passed since the system 10 last entered the recovery mode from the fluid supply mode. If the time period is less than a first preset time period, then there is a first time lapse before the controller 40 enters the fluid supply mode. If the time period is greater than a second preset time period, then there is a second time lapse before the controller 40 enters the fluid supply mode with the first time lapse being greater than the second time lapse. If the time period between the first cycle in the recovery mode and the second cycle in the recovery mode is greater than the first preset time period and less than the second preset time period, then there is a third time lapse before the controller enters the fluid supply mode, the third time lapse is less than the first time lapse and greater than the second time lapse. The third time lapse is proportional to a ratio of the difference between the second time lapse and the first time lapse and a difference between the second preset time period and the first preset time period.

Figure 16:
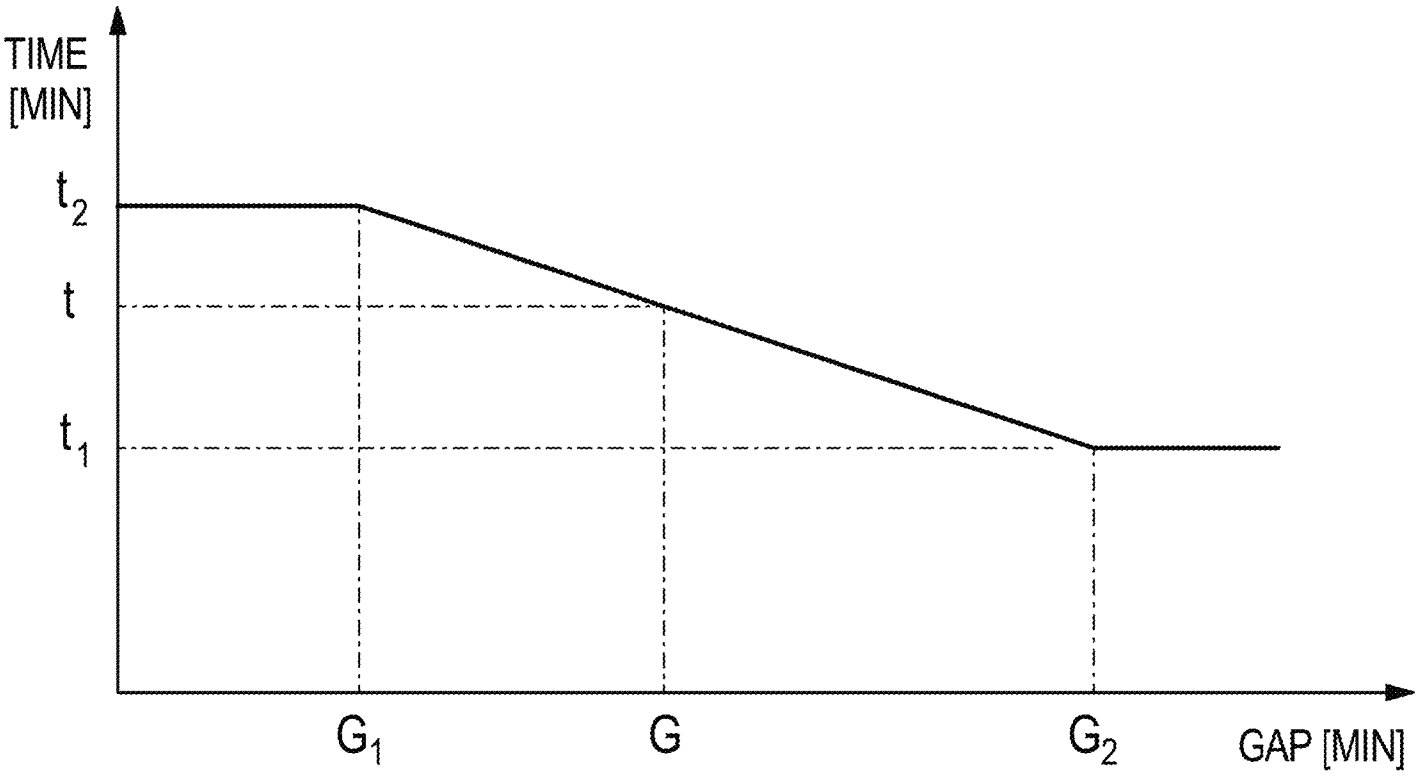
FIG. 16 is a graphical representation of a control feature of the adiabatic cooling system of FIG. 1.

The graph of FIG. 16 further illustrates the time lapse adjustment described above. For example, if the time period between the previous two recovery modes is less than a preset time $G_1$, then wetting of the outer evaporative panels 26 via the fluid supply mode stops for a time lapse $t_2$. This means that the supply valve 36 is closed and additional water is prevented from entering the system 10 for $t_2$ minutes. If the time period between the previous two recovery modes is greater than a present time $G_2$, with $G_2>G_1$, then wetting of the outer evaporative panels 26 via the fluid supply mode stops for a time lapse $t_1$, with $t_1<t_2$. This means that the supply valve 36 is closed and additional water is prevented from entering the system 10 for $t_1$ minutes. If the time period (G) between the previous two recovery modes is less than the preset time $G_2$ but longer than the preset time $G_1$, then wetting of the outer evaporative panels via the fluid supply mode stops for time lapse (t) that is calculated proportionally. The preset times $G_1$, $G_2$ and time lapses $t_1$, $t_2$ are preset values that are determined based on the design of the system 10 and impacted by parameters such as size of the system 10, capacity, geographic location, etc.

Figure 15:
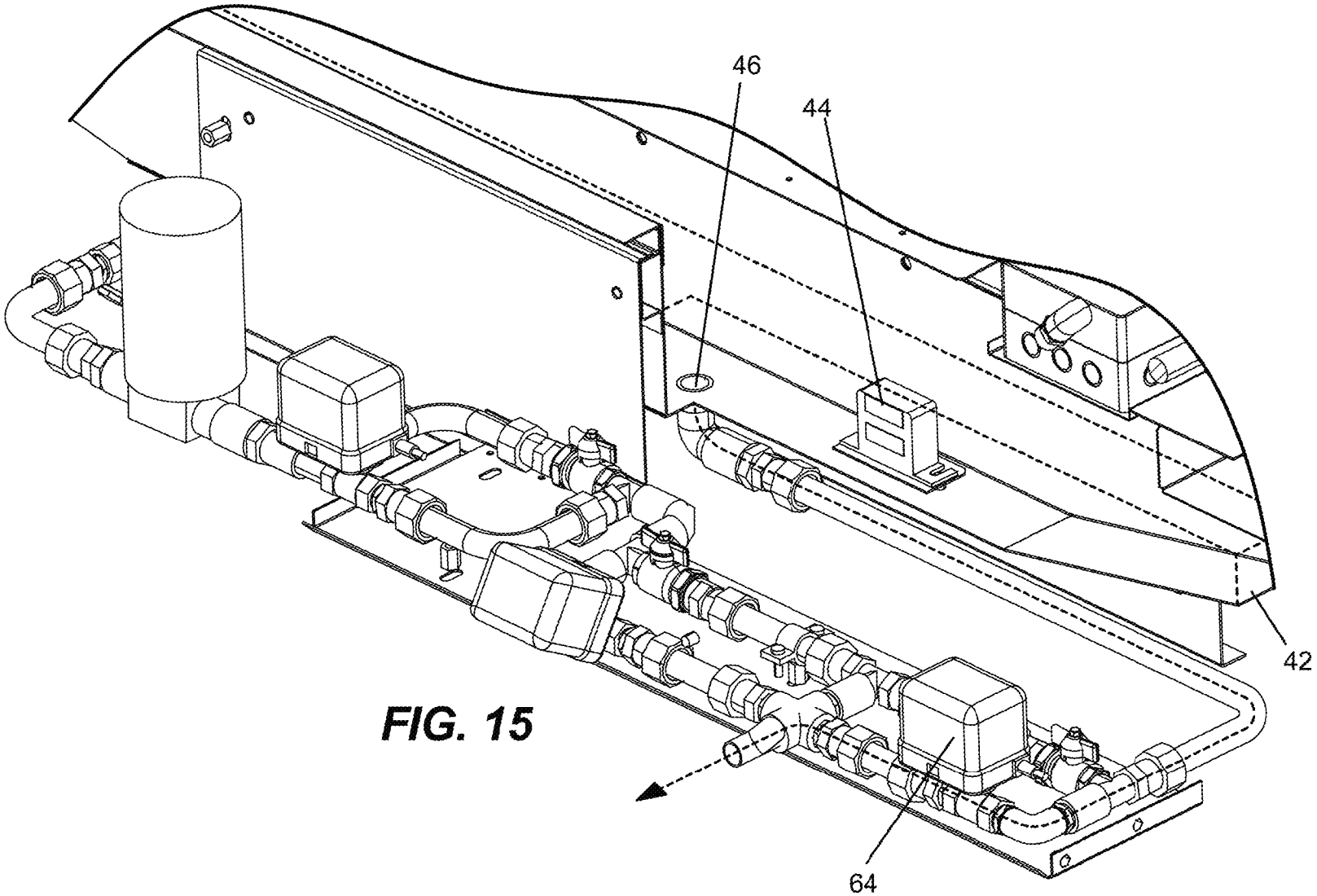
FIG. 15 illustrates a perspective view of the adiabatic cooling system of FIG. 1 illustrating a drain.

Referring to FIG. 15, in one embodiment, the system 10 includes a drain valve 64. The controller 40 can open the drain valve 64 to drain the collector 42. For example, if the fluid level sensor 44 determines that the fluid level in the collector 42 is at a maximum level, the drain valve 64 opens to drain excess fluid in the collector 42.

Figure 13:
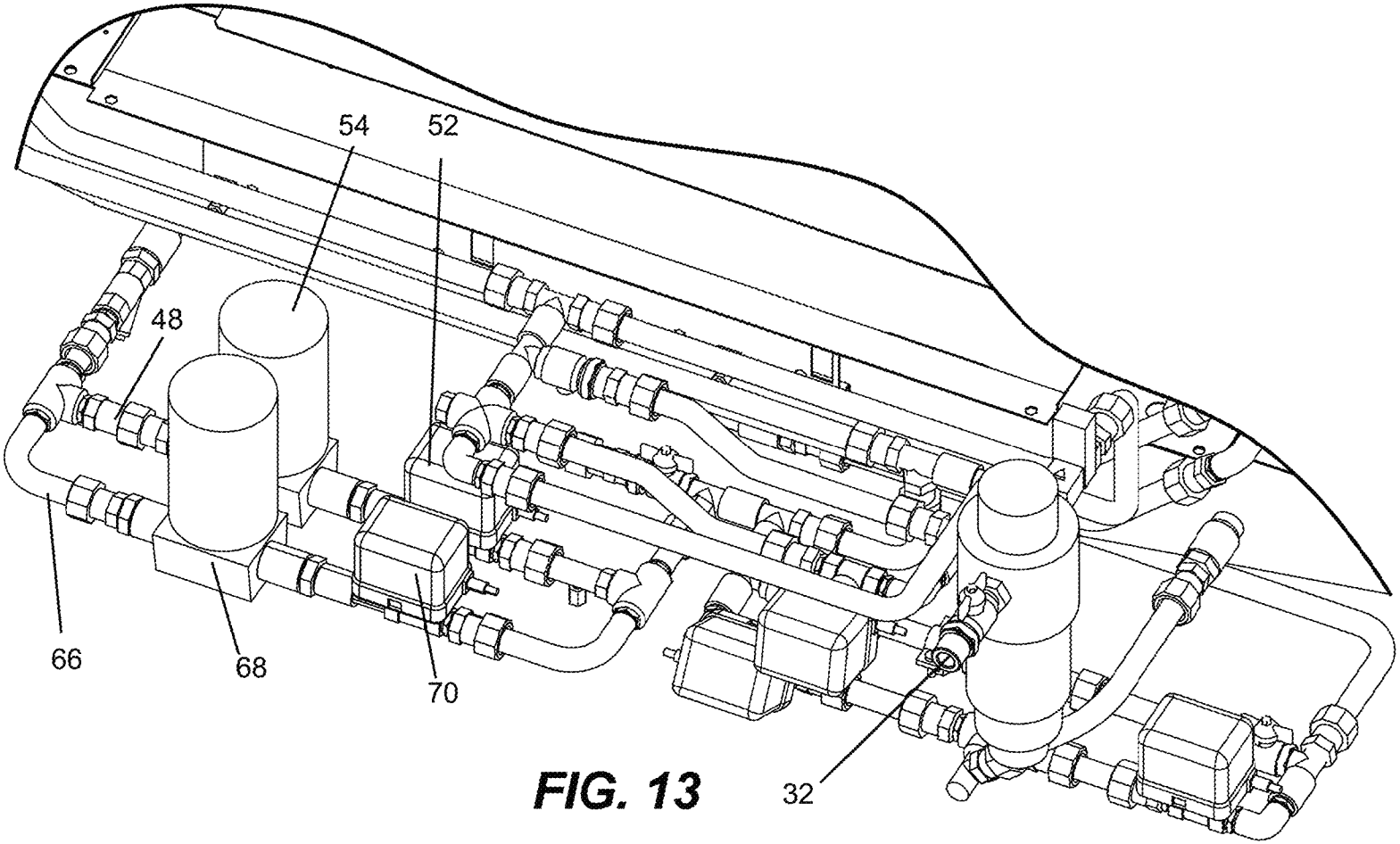
FIG. 13 illustrates an adiabatic cooling system according to another embodiment.
Figure 14:
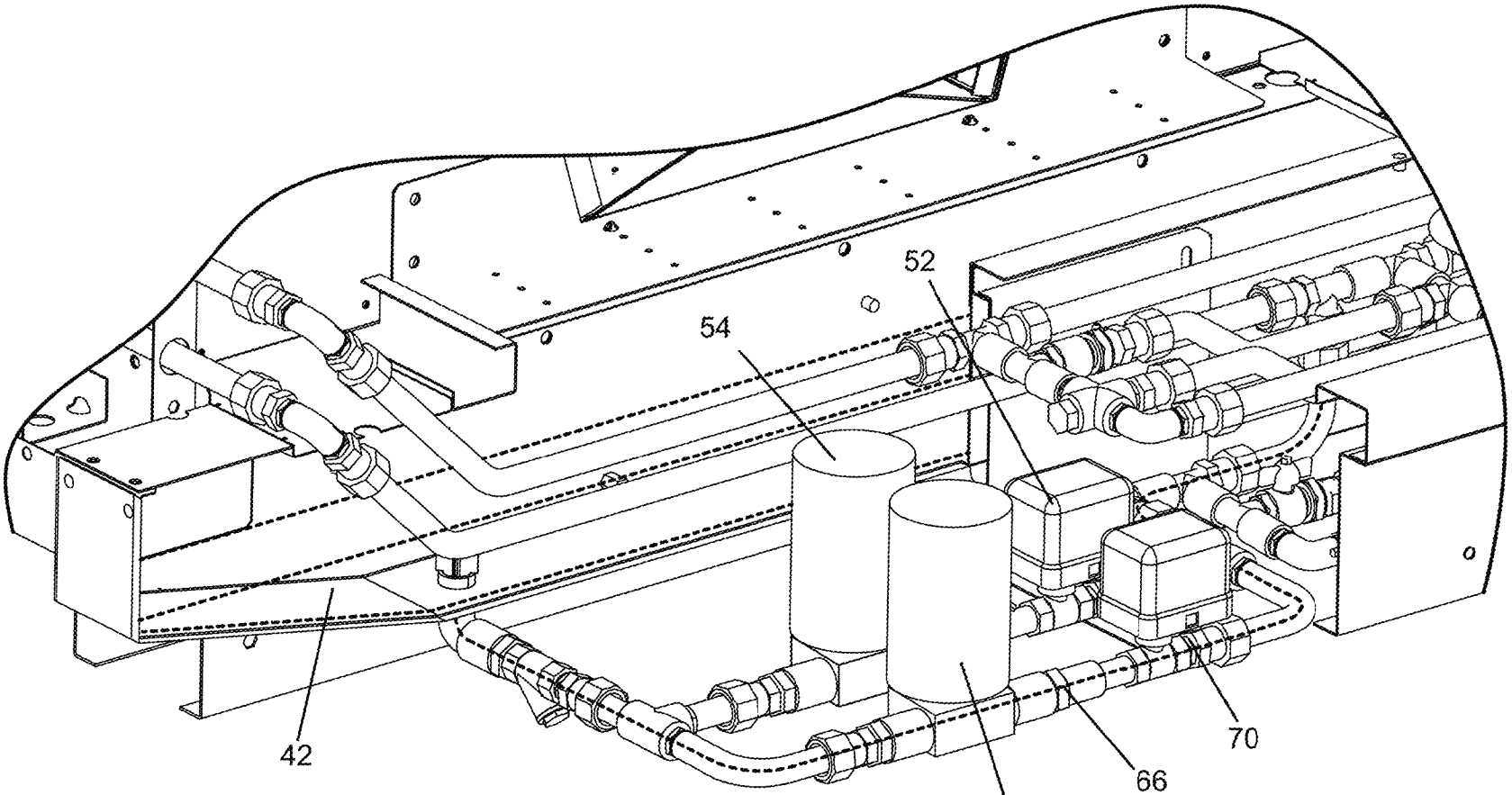
FIG. 14 is an alternative view of the adiabatic cooling system of FIG. 13.

FIGS. 13 and 14 illustrate an alternative embodiment where the system includes a second fluid recovery circuit 66. The second fluid recovery circuit 66 may function as a back up to in the event of a failure in the recover fluid circuit 48. For example, if the pump 54 and/or the recovery valve 52 in the circuit 48 fail, the second fluid recovery circuit 66 is used as a back up system. The second fluid recovery circuit 66 includes a second pump 68 and a second recovery valve 70 that are able to supply fluid from the collector 42 to the inner evaporative panels 28 similar to the first or primary recovery fluid circuit 48. In such an embodiment, the controller 40 determines if the fluid level in the collector 42 exceeds a level that indicates a failure in the primary recovery fluid circuit 48. If the level indicates a failure, the controller 40 enables operation of the second fluid recovery circuit to supply fluid from the collector 42 to the inner evaporative panels 28. In an alternative embodiment, a venturi, rather than the second pump 38, is in communication with the second recovery fluid circuit and configured to move the recovery fluid from the collector to the evaporative panel.

Various additional features and advantages of the invention are set forth in the following claims.

The invention claimed is:

1. An adiabatic cooling system comprising:

a housing;

a heat exchanger coupled to the housing, the heat exchanger configured to cool a working fluid;

an evaporative panel coupled to the housing;

a fan coupled to the housing and operable to draw an airflow through the evaporative panel and the heat exchanger to cool the working fluid within the heat exchanger;

a fluid supply circuit configured to receive a fluid from a fluid supply, the fluid supply circuit includes a supply valve operable to control fluid flow from the fluid supply through the fluid supply circuit to deliver the fluid to the evaporative panel to wet the evaporative panel using fluid from the fluid supply;

a collector coupled to the housing and configured to receive a recovery fluid from the evaporative panel;

a fluid level sensor configured to detect a recovery fluid level in the collector;

a recovery fluid circuit in fluid communication with the collector, the recovery fluid circuit including a recovery valve operable to control fluid flow through the recovery fluid circuit to deliver the recovery fluid to the evaporative panel to wet the evaporative panel using recovery fluid from the collector; and a controller in communication with the fluid level sensor and the controller operable to control operation of the fan, the supply valve, and the recovery valve, wherein when the recovery fluid level in the collector is less than a first predetermined amount, the controller operates in a fluid supply mode where the supply valve is open and the fluid supply circuit directs the fluid from the fluid supply to the evaporative panel to wet the evaporative panel using the fluid from the fluid supply, wherein when the recovery fluid level in the collector is greater than a second predetermined amount, the controller operates in a recovery mode where the recovery valve is open and the recovery fluid circuit directs the recovery fluid from the collector to the evaporative panel to wet the evaporative panel using the recovery fluid from the collector, wherein the controller is operable to determine a time period of a first cycle in the fluid supply mode, wherein the time period is an amount of time between a first cycle in the recovery mode and a second cycle in the recovery mode, determining whether the time period is less than a first preset time period or greater than a second preset time period, if the time period is less than the first preset time period, then there is a first time lapse before the controller enters a second cycle in the fluid supply mode, and if the time period is greater than the second preset time period, then there is a second time lapse before the controller enters the second cycle in the fluid supply mode, and wherein the first time lapse is greater than the second time lapse.

2. The adiabatic cooling system of claim 1, wherein if the time period between the first cycle in the recovery mode and the second cycle in the recovery mode is greater than the first preset time period and less than the second preset time period, then there is a third time lapse before the controller enters the second cycle in the fluid supply mode, the third time lapse is less than the first time lapse and greater than the second time lapse.

3. The adiabatic cooling system of claim 2, wherein the third time lapse is proportional to a ratio of a difference between the second time lapse and the first time lapse and a difference between the second preset time period and the first preset time period.

4. The adiabatic cooling system of claim 1, wherein the evaporative panel is a first evaporative panel coupled to the housing and further comprising a second evaporative panel coupled to the housing, wherein in the fluid supply mode, the fluid supply circuit directs the fluid from the fluid supply to wet the first evaporative panel, and wherein in the recovery mode, the recovery fluid circuit directs the recovery fluid from the collector to wet the second evaporative panel.

5. The adiabatic cooling system of claim 1, wherein the recovery fluid circuit is a first recovery fluid circuit, the adiabatic cooling system further comprising a second fluid recovery fluid circuit operable to deliver the recovery fluid from the collector to the evaporative panel, wherein the controller is operable to enable operation of the second fluid recovery circuit in response to the recovery fluid level in the collector sensed by the fluid level sensor.

6. The adiabatic cooling system of claim 5, further comprising a first pump in communication with the first recovery circuit and configured to pump the recovery fluid from the collector to the evaporative panel and a second pump in communication with the second recovery fluid circuit and configured to pump the recovery fluid from the collector to the evaporative panel.

7. The adiabatic cooling system of claim 1, further comprising a temperature sensor in communication with the controller to determine an external air temperature; and an air humidity sensor in communication with the controller to determine an external relative humidity, wherein the controller is operable to operate the adiabatic cooling system in a dry mode where the supply valve is closed and the recovery mode is disabled in response to the external air temperature being less than a reference temperature and the external relative humidity being greater than a reference humidity.

8. The adiabatic cooling system of claim 1, wherein the supply valve is closed when the controller operates in the recovery mode to inhibit fluid flow from the fluid supply to the evaporative panel.

9. The adiabatic cooling system of claim 1, wherein the controller, while operating in the recovery mode, is operable to determine when the recovery fluid level is below the first predetermined amount and the second predetermined amount and when the recovery fluid level is below the first predetermined amount and the second predetermined amount, the controller operates the adiabatic cooling system in the fluid supply mode.

10. The adiabatic cooling system of claim 1, wherein the first predetermined amount of recovery fluid in the collector is equal to the second predetermined amount of recovery fluid in the collector.

11. A method of controlling an adiabatic cooling system including an evaporative panel, a heat exchanger, and a controller configured to perform the method, the method comprising:

wetting the evaporative panel with a fluid;

collecting, in a collector, a recovery fluid from the evaporative panel;

determining a fluid level in the collector;

operating in a fluid supply mode when the fluid level in the collector is less than a first predetermined amount, the fluid supply mode includes wetting the evaporative panel using fluid from a fluid supply;

operating in a recovery mode when the fluid level in the collector is greater than a second predetermined amount, the recovery mode includes wetting the evaporative panel using fluid from the collector;

determining a time period of a first cycle in the fluid supply mode, wherein the time period is an amount of time between a first cycle in the recovery mode and a second cycle in the recovery mode, determining whether the time period is less than a first preset time period or greater than a second preset time period, if the time period is less than the first preset time period, then there is a first time lapse before entering a second cycle in the fluid supply mode from the recovery mode, and if the time period is greater than the second preset time period, then there is a second time lapse before entering the second cycle in the fluid supply mode from the recovery mode, and the first time lapse is greater than the second time lapse.

12. The method of claim 11, further comprising determining whether the time period between the first cycle in the recovery mode and the second cycle in the recovery mode is greater than the first preset time period and less than the second preset time period, and if so, then there is a third time lapse before entering the second cycle in the fluid supply mode, the third time lapse is less than the first time lapse and greater than the second time lapse.

13. The method of claim 12, further comprising calculating the third time lapse as proportional to a ratio of a difference between the second time lapse and the first time lapse and a difference between the second preset time period and the first preset time period.

14. The method of claim 11, further comprising determining an external air temperature;

determining an external relative humidity;

operating the adiabatic cooling system in a dry mode where both the fluid supply mode and the recovery mode are disabled in response to the external air temperature being less than a reference temperature and/or the external relative humidity being greater than a reference humidity.

* * * * *